US011279518B2

(12) United States Patent
Kögel et al.

(10) Patent No.: US 11,279,518 B2
(45) Date of Patent: Mar. 22, 2022

(54) STACKABLE SYSTEM CONTAINER AND TRANSPORT SYSTEM

(71) Applicant: BS Systems GmbH & Co. KG, Zusmarshausen (DE)

(72) Inventors: Jan Kögel, Zusmarshausen (DE); Maximo Arroyo-Marin, Augsburg (DE); Matthias Steber, Langenneufnach (DE); Reiner Gonitianer, Dillingen (DE)

(73) Assignee: BS SYSTEMS GMBH & CO. KG, Zusmarshausen (DE)

( * ) Notice: Subject to any disclaimer, the term of this patent is extended or adjusted under 35 U.S.C. 154(b) by 0 days.

(21) Appl. No.: 16/764,930

(22) PCT Filed: Jun. 5, 2018

(86) PCT No.: PCT/EP2018/064742
§ 371 (c)(1),
(2) Date: May 18, 2020

(87) PCT Pub. No.: WO2019/105598
PCT Pub. Date: Jun. 6, 2019

(65) Prior Publication Data

US 2020/0346819 A1 Nov. 5, 2020

(30) Foreign Application Priority Data

Nov. 30, 2017 (DE) ..... 10 2017 128 493.1

(51) Int. Cl.
*B65D 21/02* (2006.01)
*B25H 3/02* (2006.01)
*A45C 5/03* (2006.01)

(52) U.S. Cl.
CPC ..... *B65D 21/0223* (2013.01); *B25H 3/021* (2013.01); *A45C 2005/037* (2013.01);
(Continued)

(58) Field of Classification Search
CPC ..... B65D 21/0223; B65D 21/0212; B65D 21/062; B65D 21/0217; B65D 21/0219;
(Continued)

(56) References Cited

U.S. PATENT DOCUMENTS 3,743,372 A * 7/1973 Ruggerone ..... A47B 87/02 312/108
3,759,411 A * 9/1973 Horvath ..... B65D 50/06 215/209
(Continued)

FOREIGN PATENT DOCUMENTS

DE 7244356 U 5/1974
DE 4009960 A1 10/1990
(Continued)

OTHER PUBLICATIONS

Final Office Action dated Feb. 22, 2021 for U.S. Appl. No. 16/317,234.
(Continued)

*Primary Examiner* — J. Gregory Pickett
*Assistant Examiner* — Abigail Elizabeth Guidry
(74) *Attorney, Agent, or Firm* — Paul D. Bianco; Fielt Intellectual Property Law

(57) ABSTRACT

Known system containers or transport systems have the disadvantage that a precise prior adjustment is necessary for the purpose of connecting the same. The disclosed system container or transport system is configured in such a way that a particularly stable and intuitive mutual fastening is made possible. Runways of the system container project in the direction of each other, and at least one upwardly protruding locking lug is provided on the lid part.

12 Claims, 2 Drawing Sheets

(52) U.S. Cl.
CPC ..... *B65D 21/0212* (2013.01); *B65D 2543/00027* (2013.01); *B65D 2543/00194* (2013.01)

(58) Field of Classification Search
CPC ..... B65D 21/0213; B65D 21/0237; B65D 21/0222; B65D 2543/00027; B65D 2543/00194; B65D 2543/00009; B65D 2543/00101; B65D 2543/00296; B65D 2543/00379; B65D 21/0215; B65D 21/0204; B65D 21/0201; B65D 21/0209; B25H 3/021; B25H 3/022; B25H 3/027; A45C 2005/037; A45C 5/14; A45C 7/005; A45C 7/0045; A45C 13/02; A45F 3/10
See application file for complete search history.

(56) References Cited

U.S. PATENT DOCUMENTS 3,888,350 A * 6/1975 Horvath ..... B65D 50/045 206/531
4,122,925 A * 10/1978 Schultheiss ..... A45C 5/00 190/108
4,126,224 A * 11/1978 Laauwe ..... B65D 50/06 206/540
4,216,857 A * 8/1980 Huang ..... E05C 19/022 206/1.5
4,243,279 A * 1/1981 Ackeret ..... B65D 21/0201 108/64
4,353,473 A * 10/1982 Morris ..... B65D 50/068 215/206
4,364,488 A * 12/1982 Anjou ..... A24F 27/00 220/281
4,426,056 A * 1/1984 Gelardi ..... G11B 23/023 206/387.13
4,431,237 A * 2/1984 Saito ..... G11B 23/023 206/387.1
4,457,433 A * 7/1984 Wilson ..... B65D 21/048 206/505
4,643,494 A 2/1987 Marleau
4,671,943 A 6/1987 Wahlquist
D292,634 S 11/1987 Chabot
4,820,499 A 4/1989 Taschner
4,842,142 A * 6/1989 Kreeger ..... B65D 21/04 206/505
5,101,969 A 4/1992 Umiker
5,176,281 A * 1/1993 Fiore ..... A45C 7/0045 190/102
D340,353 S 10/1993 Benarrouch
5,347,693 A * 9/1994 Otrusina ..... A45F 5/02 24/3.12
5,379,887 A 1/1995 Conley, Jr.
D355,764 S 2/1995 Apps
D356,211 S 3/1995 Apps
D356,679 S 3/1995 Apps
5,429,235 A * 7/1995 Chen ..... A45C 7/0045 206/372
D360,757 S 8/1995 Snetting
D361,663 S 8/1995 Kalin
5,445,273 A 8/1995 Apps
5,495,945 A 3/1996 Apps
5,890,613 A 4/1999 Williams
D416,682 S 11/1999 Tanji
5,979,654 A 11/1999 Apps
6,006,969 A * 12/1999 Kim ..... A45F 5/021 224/197
6,082,539 A 7/2000 Lee
D439,408 S 3/2001 Gibson
6,250,730 B1 * 6/2001 Roth ..... E05B 65/0014 312/333
D446,015 S 8/2001 Apps
D448,567 S 10/2001 Buss
D452,613 S 1/2002 Hammett
D462,522 S 9/2002 Apps
D470,658 S 2/2003 Chunn
D478,421 S 8/2003 Overholt et al.
D483,946 S 12/2003 Koefelda
D487,634 S 3/2004 Apps et al.
6,786,372 B2 * 9/2004 Enkerlin ..... A45F 5/02 224/196
6,874,634 B2 4/2005 Riley
6,880,869 B2 4/2005 Schainholz
6,889,838 B2 5/2005 Meier et al.
7,000,287 B2 2/2006 Valentini
D520,237 S 5/2006 Cheng
D520,734 S 5/2006 Henning et al.
D524,651 S 7/2006 Perret
D539,541 S 4/2007 Stahl
D542,529 S 5/2007 Peart et al.
D557,011 S 12/2007 Fernandez et al.
D572,479 S 7/2008 Buck
D595,958 S 7/2009 Twig
D598,684 S 8/2009 Stahl
7,573,385 B2 8/2009 Tonelli
D600,015 S 9/2009 Wenchel
D601,797 S 10/2009 Wenchel
D608,094 S 1/2010 Concari
D616,200 S 5/2010 Riedel et al.
D620,255 S 7/2010 Chang
D630,435 S 1/2011 Brunner
8,061,492 B2 11/2011 Riedel et al.
8,186,534 B2 5/2012 Apps
D668,867 S 10/2012 Yamamot
8,403,438 B2 * 3/2013 Park ..... F25D 25/02 312/408
D688,869 S 9/2013 Lindstrom
8,522,967 B2 9/2013 Lindstrom
8,590,704 B2 11/2013 Koenig et al.
8,677,661 B2 3/2014 Michels et al.
D704,442 S 5/2014 Chen
D719,352 S 12/2014 Shitrit
8,919,623 B1 * 12/2014 Bergeron ..... A45F 5/021 224/148.4
D738,106 S 9/2015 Shitrit
9,131,770 B2 * 9/2015 Stegherr ..... B65D 21/0228
D750,890 S 3/2016 Quehl
D757,435 S 5/2016 Damberg
D759,975 S 6/2016 Zozin
D785,938 S 5/2017 Ou
D790,221 S 6/2017 Yahav
D792,708 S 7/2017 Tazawa
D798,053 S 9/2017 Shitrit
D801,685 S 11/2017 Meng
D808,653 S 1/2018 Rayeski
D811,084 S 2/2018 Ballou
RE47,022 E 9/2018 Sosnovsky
D833,743 S 11/2018 Tonelli
D841,981 S 3/2019 Kogel
D841,982 S 3/2019 Kogel
D841,983 S 3/2019 Wang
10,405,626 B2 9/2019 Gonitianer
D872,471 S 1/2020 Zhao
D873,004 S 1/2020 Shpitzer
D882,952 S 5/2020 Austin
10,703,534 B2 6/2020 Brunner
10,710,770 B2 7/2020 Kogel
10,829,269 B2 11/2020 Gonitianer et al.
10,870,513 B2 * 12/2020 Gonitianer ..... B25H 3/02
D918,580 S * 5/2021 Kogel ..... D3/276
11,044,976 B1 * 6/2021 Debro ..... B44D 3/00
11,072,461 B2 * 7/2021 Gonitianer ..... B25H 3/02
2002/0132592 A1 * 9/2002 Fan ..... A45F 5/02 455/575.1
2003/0094392 A1 5/2003 Meier et al.
2003/0102970 A1 6/2003 Creel et al.
2003/0141326 A1 * 7/2003 Bennett ..... A01K 65/00 224/103
2003/0141329 A1 * 7/2003 Huang ..... A45F 5/02 224/197
2003/0162510 A1 * 8/2003 Kim ..... A45F 5/02 455/575.1

(56) References Cited

U.S. PATENT DOCUMENTS

| | | | | |
|---|---|---|---|---|
| 2006/0049640 | A1 | 3/2006 | Lee | |
| 2006/0170558 | A1 | 8/2006 | Tonelli | |
| 2008/0067091 | A1 | 3/2008 | Chang | |
| 2008/0251396 | A1 | 10/2008 | Oh | |
| 2009/0236255 | A1 | 9/2009 | Piacenza et al. | |
| 2009/0256454 | A1* | 10/2009 | Landau | B25H 3/028 312/249.11 |
| 2010/0147642 | A1* | 6/2010 | Andochick | A45C 13/1076 190/18 A |
| 2010/0147732 | A1* | 6/2010 | Delagrange | B65D 47/0804 206/528 |
| 2011/0121695 | A1 | 5/2011 | Purdy | |
| 2011/0139666 | A1 | 6/2011 | Sosnovsky et al. | |
| 2011/0147256 | A1 | 6/2011 | Atherton et al. | |
| 2011/0186397 | A1 | 8/2011 | Sheikh | |
| 2011/0233096 | A1 | 9/2011 | Michels et al. | |
| 2014/0062281 | A1 | 3/2014 | Stegherr | |
| 2014/0262885 | A1 | 9/2014 | Green et al. | |
| 2016/0008972 | A1 | 1/2016 | Chen | |
| 2016/0144500 | A1 | 5/2016 | Chen | |
| 2016/0213115 | A1 | 7/2016 | Gonitianer et al. | |
| 2017/0318927 | A1* | 11/2017 | Kraus | A45C 13/02 |
| 2018/0220758 | A1 | 8/2018 | Burchia | |
| 2019/0291922 | A1 | 9/2019 | Gonitianer | |
| 2019/0308772 | A1 | 10/2019 | Gonitianer | |
| 2019/0315515 | A1 | 10/2019 | Gonitianer | |
| 2021/0139186 | A1* | 5/2021 | Kobayashi | B65D 21/0212 |
| 2021/0259397 | A1 | 8/2021 | Stegherr et al. | |

FOREIGN PATENT DOCUMENTS

| | | | | |
|---|---|---|---|---|
| DE | 4107267 | A1 | 9/1992 | |
| DE | 9314298 | U1 | 2/1994 | |
| DE | 29723812 | U1 | 4/1999 | |
| DE | 102006002475 | | 7/2006 | |
| DE | 202005015040 | | 8/2006 | |
| DE | 10 2007 032382 | A1 | 1/2008 | |
| DE | 202012102760 | U1 | 12/2012 | |
| DE | 10 2011 110207 | A1 | 2/2013 | |
| DE | 20 2013 003741 | U1 | 4/2013 | |
| DE | 202014101556 | U1 | 7/2014 | |
| DE | 20 2014 103695 | U1 | 10/2014 | |
| DE | 10 2013 110496 | A1 | 3/2015 | |
| DE | 102013110496 | | 3/2015 | |
| DE | 20 2015 005752 | U1 | 11/2016 | |
| DE | 202015005752 | | 12/2016 | |
| DE | 10 2016 112853 | A1 | 1/2018 | |
| EP | 0555533 | A1 | 8/1993 | |
| EP | 0997234 | A1 | 5/2000 | |
| EP | 1 238 602 | A2 | 9/2002 | |
| EP | 1238602 | A2 | 9/2002 | |
| EP | 1516703 | A1 | 3/2005 | |
| EP | 2020188 | A1 | 2/2009 | |
| EP | 2703310 | A1 | 3/2014 | |
| GB | 2459288 | | 10/2009 | |
| WO | WO-0008882 | A1 * | 2/2000 | H04M 1/04 |
| WO | 01/25701 | | 4/2001 | |
| WO | 02/11955 | A1 | 2/2002 | |
| WO | 2011/000387 | A1 | 1/2011 | |
| WO | 2011/032568 | | 3/2011 | |
| WO | 2016/091570 | A1 | 6/2016 | |
| WO | WO-2016091570 | A1 * | 6/2016 | A45C 7/0045 |
| WO | 2017/001083 | A1 | 1/2017 | |
| WO | 2018/10857 | A1 | 1/2018 | |
| WO | 2018/10859 | A1 | 1/2018 | |

OTHER PUBLICATIONS

International Search Report and Written Opinion for PCT/EP2017/058672 filed Apr. 11, 2017.
Result of Examination Report for DE 10 2016 112 853.8, filed Jul. 13, 2016.
International Search Report and Written Opinion for PCT/EP2017/058667 filed Apr. 11, 2017.
Result of Examination Report for DE 10 2016 112 854.6, filed Jul. 13, 2016.
International Search Report and Written Opinion for PCT/EP2017/058668 filed Apr. 11, 2017.
Result of Examination Report for DE 10 2016 112 855.4, filed Jul. 13, 2016.
Result of examination report for German Application No. 10 2013 110 496.7, filed Sep. 23, 2013.
Result of examination report of German Application No. 10 2017 117 823.6, filed Aug. 7, 2017.
International Search Report, Written Opinion and International Preliminary Report on Patentability for PCT/EP2014/068714, filed Mar. 26, 2015.
Office Action dated Sep. 29, 2020 for U.S. Appl. No. 16/317,234.
International Search Report dated Jun. 26, 2018, for PCT/EP2018/064742, filed Jun. 5, 2018.
Written Opinion for PCT/EP2018/064742, filed Jun. 5, 2018.
Result of Examination Report for German Application No. 10 2017 128 493.1, filed Nov. 30, 2017.
Notice of Allowance dated Sep. 22, 2020 for U.S. Appl. No. 16/317,175.
Notice of Allowance dated Sep. 22, 2020 for U.S. Appl. No. 16/317,188.
Office Action dated Apr. 16, 2020, for U.S. Appl. No. 16/317,175.
International Search Report, Written Opinion and International Preliminary Report on Patentability for PCT/EP2018/064742, filed Jun. 5, 2018.
Youtube, XL-Boxx—The large power tool and transport case in the L-Boxx System posted by user Alexander Schweyer on Oct. 7, 2019 (https://ww.youtube.com/watch?v=A3gakVZn_y!) 2019.
Home Depot, 6"H × 14"W × 17.5"L Compartment Small Part Organizer first reviewed on Apr. 2, 2012 2012.
Office Action dated Jul. 20, 2020, for Design U.S. Appl. No. 29/679,432.
For U.S. Appl. No. 16/317,188: Response dated Jun. 1, 2020 Final Office Action dated Jun. 29, 2020.
For U.S. Appl. No. 16/317,234: Response to office action filed Dec. 29, 2020.
For U.S. Appl. No. 16/317,188: Reply to Office Action dated Sep. 14, 2020.
English translation of International Preliminary Examination Report for PCTEP17/058667, filed Apr. 11, 2017.
English translation of International Preliminary Examination Report for PCT/EP17/058668, filed Apr. 11, 2017.
International Preliminary Examination Report with English translation of Written Opinion for PCT/EP17/058672, filed Apr. 11, 2017.
For U.S. Appl. No. 29/679,432: Response filed Nov. 19, 2020 Final Office Action dated Dec. 2, 2020.
Notice of Allowance dated Mar. 15, 2021 for U.S. Appl. No. 29/679,432.
Response to Final Office Action filed Mar. 2, 2021 for U.S. Appl. No. 29/679,432.
Response to Office Action filed Jul. 15, 2020 for U.S. Appl. No. 16/317,175, filed Jan. 11, 2019.
Office Action for U.S. Appl. No. 16/317,188, dated Mar. 18, 2020.
Restriction Requirement Office Action dated May 19, 2020 for U.S. Appl. No. 16/317,234.
For U.S. Appl. No. 16/317,234: Response to Final Office Action filed Apr. 29, 2021 Notice of Allowance dated May 10, 2021.
Australian Examination Report dated Mar. 18, 2021 for Australian Patent Application No. 2021200186.
European Search Report dated Jun. 1, 2021 for European Patent Application No. EP 20 21 6276.

* cited by examiner

STACKABLE SYSTEM CONTAINER AND TRANSPORT SYSTEM

FIELD OF THE INVENTION

The present invention relates to a stackable system container, an additional container and a transport system.

BACKGROUND

DE 10 2013 110 496 discloses a stackable system container, comprising a bottom part with an upwardly open storage space and a lid part pivotably attached to the bottom part and upwardly delimiting the storage space. The system container also has two coupling devices movably attached to opposite side walls of the bottom part, which serve to couple the system container to additional system containers and thereby allow such system containers to be securely stacked one on top of the other. The coupling devices are configured to move between a resting position, in which the coupling device is disengaged from the second system container, and a coupling position, in which the coupling devices are brought into engagement with the second system container, and designed to interact with and hold complementary coupling elements of a similar container disposed below, which coupling elements protrude upwardly beyond an upper surface of the system container or, more specifically, the lid part. The coupling elements are an integral component of the respective bottom part and each comprise at least one latch for engaging the coupling device. Furthermore, the coupling elements are disposed at opposite ends of the upper surface of the system container and make it possible to center, position and stack a plurality of such system containers one on top of the other. After aligning a plurality of system containers, these system containers can be connected to each other so as to be dimensionally stable but detachable from each other by means of the coupling devices and the coupling elements. To ensure that the system containers can be easily and quickly connected to each other, the coupling devices are each biased into a coupling position, for example, so that the coupling devices automatically connect with the coupling elements of the additional system container as soon as they are joined together with sufficient pressure. This form-fitting and frictional connection makes it possible to comfortably carry a plurality of interconnected system containers in one hand.

The prior art also discloses a so-called fusion box made by the Peddinghaus Corporation, the lid of which box has external guide rails for the insertion of additional smaller boxes, with the smaller boxes being inserted so as to be clamped into associated guide grooves on the lid.

US 2009/0236255 A1 describes a stackable system container, comprising a bottom part and a lid part attached thereto, with the two parts being connected to each other by means of leaves that are attached to the bottom part and with these leaves being attached to the bottom part by means of film hinges.

DE 7 244 356 relates to a container for storing and transporting materials needed in hospitals, with the possibility of connecting a plurality of containers of the same type to each other by means of locking devices.

WO 2017/001083 describes a stackable storage container, comprising a body and a lid, with the side walls of the body having detent arms, with the body having legs, and with the upper surface of the lid having detent cams.

Also known from the prior art are accessory boxes made by the Hitachi Corporation for storing and transporting small parts, the lid of which boxes has a plurality of guide rails, into which additional superjacent boxes can be inserted. The guide rails each have a runway which, on insertion, is engaged from below by the additional container to be disposed on top. The runways are facing away from each other, i.e., each runway points to an opposite outside surface of the box. To ensure a secure connection, this requires that the two boxes be placed very precisely, one on top of the other. In addition, during the placement of the container to be disposed on top, the runways which protrude in the direction of the outside of the box are not visible, which makes the placement and insertion of the superjacent box even more difficult.

SUMMARY

Thus, one aspect of the present invention relates to a stackable system container and a transport system, which enables a particularly stable and automatic connection of a container to a system container. Accordingly, disclosed herein are a stackable system container, a second container to be disposed on top, and a transport system. Preferred embodiments of the invention are also disclosed.

The stackable system container according to the present invention is characterized in that the upper surface of the lid part has two guide rails spaced at a distance from each other. The guide rails, which are preferably aligned parallel to each other, make it possible to form-fittingly receive an additional system container. To connect the system containers to each other, the upper system container must be inserted into the guide rails of the lower system container, which results in an especially stable, form-fitting connection. The guide rails can be disposed along the edge of the lid part adjacent to two opposite side walls of the lid part or at a distance therefrom.

The guide rails each have a runway, with the runways protruding toward each other. The runways can be engaged from below by an additional container. This engagement from below enables a particularly stable interconnection.

To accelerate the insertion of a container into the guide rails of the system container, the runways can each have a recess so that it is not necessary to insert over the entire length of the guide rails but only over a part thereof, which considerably accelerates the insertion procedure.

According to a preferred embodiment, to lock stacked system containers to each other, at least one upwardly projecting locking lug is provided on the lid part. In the inserted locking position, the locking lug, which can be disposed between the guide rails or integrally formed in one of the guide rails, forms a stop so that the connected system containers cannot disconnect on their own.

In addition, it can be provided that at least one additional guide rail is disposed on the lid part between the two guide rails, so that a plurality of smaller system containers can be attached one next to the other on the lid part. To this end, the guide rail in the middle can have two runways, one of which protrudes in the direction of the lateral guide rails.

According to one embodiment that offers benefits in terms of manufacturing technology, the guide rails can be integrally formed in one piece with the lid part; however, the guide rails can also be configured as separate parts, thereby making it possible to upgrade or modify them.

According to a particularly advantageous embodiment of the invention, the bottom part can have two running rails which are configured to be complementary to the guide rails on the lid part. This allows a plurality of system containers of this type to be stacked one on top of the other particularly easily and to be detachably connected to each other.

According to one structurally advantageous embodiment, the running rails can be formed by the edges of the lower plates of the bottom part, which edges protrude laterally from oppositely lying side walls of the bottom part.

To accelerate the insertion of the additional container into the guide rails, the running rails, like the runways, can each have a recess. The recess preferably extends over a distance which is greater than the longitudinal extension of the sections of the runways that are delimited by the recesses.

To ensure that the system container is stably locked to the container, at least one of the running rails can have a locking stop corresponding to the locking lug on the lid part. The form-fitting engagement from behind between the locking stop and the locking lug ensures an especially stable locking connection in the inserted position.

According to one advantageous embodiment of the invention, the distance between the upper edge of the running rail and the lower edge of the locking stop can be greater than the height of the locking lug. Therefore, when unlocking the connection from the inserted position, a front section of the upper system container can be raised and thus be tipped about an axis at right angles to the pull-out direction so that the locking stop can be raised above, and moved away from, the locking lug.

According to one structurally advantageous embodiment, the locking stops can be formed in a lateral recess of the respective side wall of the bottom part. As a result, the locking stops are protected against external interference and hidden in a visually attractive way.

In addition, the present invention also claims a transport system, comprising a system container and an additional container, on the lid part of which system container guide rails, each with a runway, are disposed, which can be engaged from behind and held by complementary running rails of the container to be disposed on top.

According to one advantageous embodiment of the invention, the transport system can comprise a locking device with at least one locking lug and a corresponding locking stop for locking the second system container in an inserted rear locking position.

Preferably, a locking lug is each disposed on the guide rails to guide the second system container in the pull-out direction. In this manner, twisting between the container and the system container is avoided.

BRIEF DESCRIPTION OF THE DRAWINGS

Additional special features and advantages of the invention follow from the following description of preferred illustrative embodiments with reference to the drawings. The drawings show.

DETAILED DESCRIPTION

Figure 1:
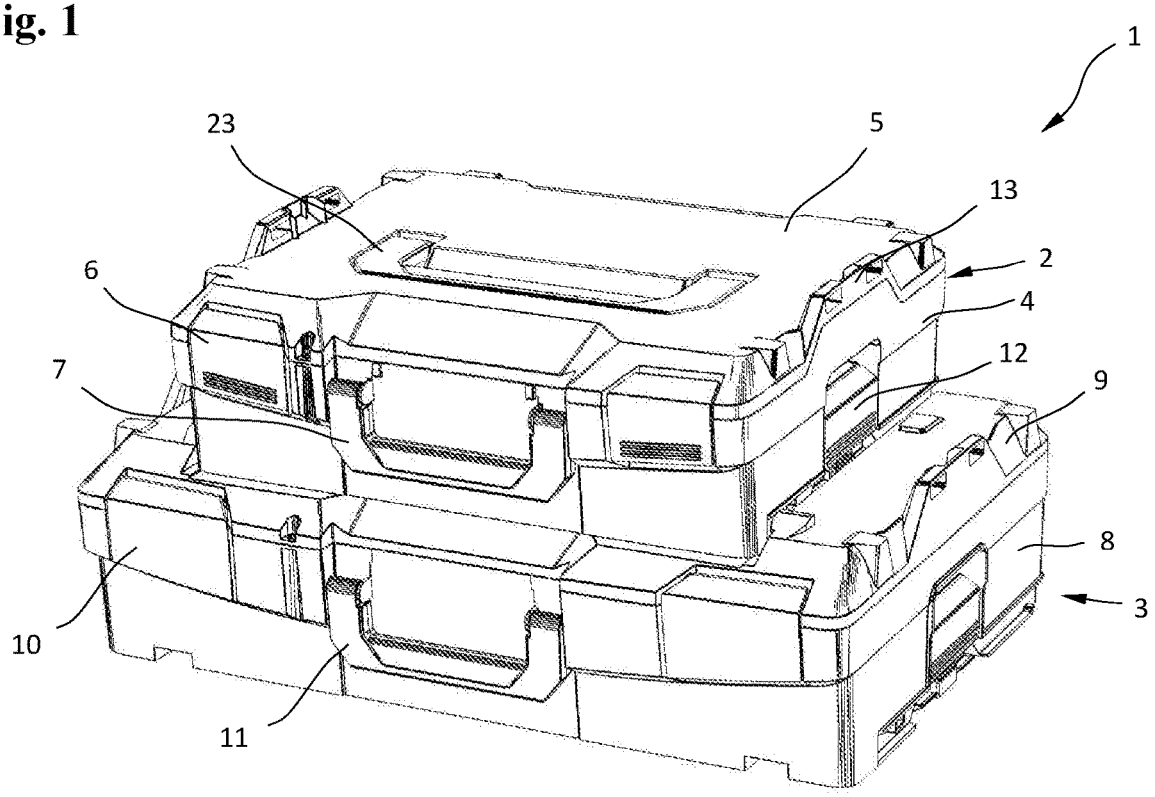
FIG. 1 a perspective view of a transport system, comprising a system container and an additional container disposed on top.

FIG. 1 shows a perspective view of a transport system 1, comprising an upper container 2 and a lower system container 3 detachably connected thereto. The upper container 2 has a bottom part 4 and a lid part 5 pivotably connected thereto, which parts delimit a storage space of the container 2. By means of locking tabs 6, the lid part 5 can be secured relative to the bottom part 4 in the locking position shown in order to prevent the upper container 2 from being unintentionally opened. In addition, on the front side, the upper container 2 also has a carrying handle 7 which is pivotably attached to the bottom part 4. The (lower) system container 3 has a similar configuration, comprising a bottom part 8 and a lid part 9 pivotably connected thereto, which parts can be secured relative to each other in the closed position shown by means of locking tabs 10. In addition, a carrying handle 11 is also pivotably attached to the front side of the bottom part 8 of the lower system container 3.

On opposite side walls of the bottom part 4, the upper container 2 has pivotably disposed coupling devices 12, and on the upper surface of the lid part 5, coupling elements 13 complementary thereto. This type of configuration of the upper container 2 makes it possible to stack a plurality of containers of identical design one on top of the other and to detachably connect them by means of the coupling device and the coupling elements. As to the design of the coupling device, reference is made to the disclosure of DE 10 2013 110 496 and DE 10 2016 112 853, the content of which is hereby fully incorporated into this Application by reference.

The lower system container 3 also comprises appropriate coupling devices and coupling elements in order to be able to stack a plurality of system containers one on top of the other and to securely connect them to each other.

Both the upper container 2 and the lower system container 3 are configured to be a mirror image of each other so that the elements of the containers 2, 3 on the left side and on the right side are identical, as indicated by the figures. Although, for clarity's sake, only one side is being described, the description nonetheless always applies to the opposite mirror-image side of the containers 2, 3 as well.

Figure 2:
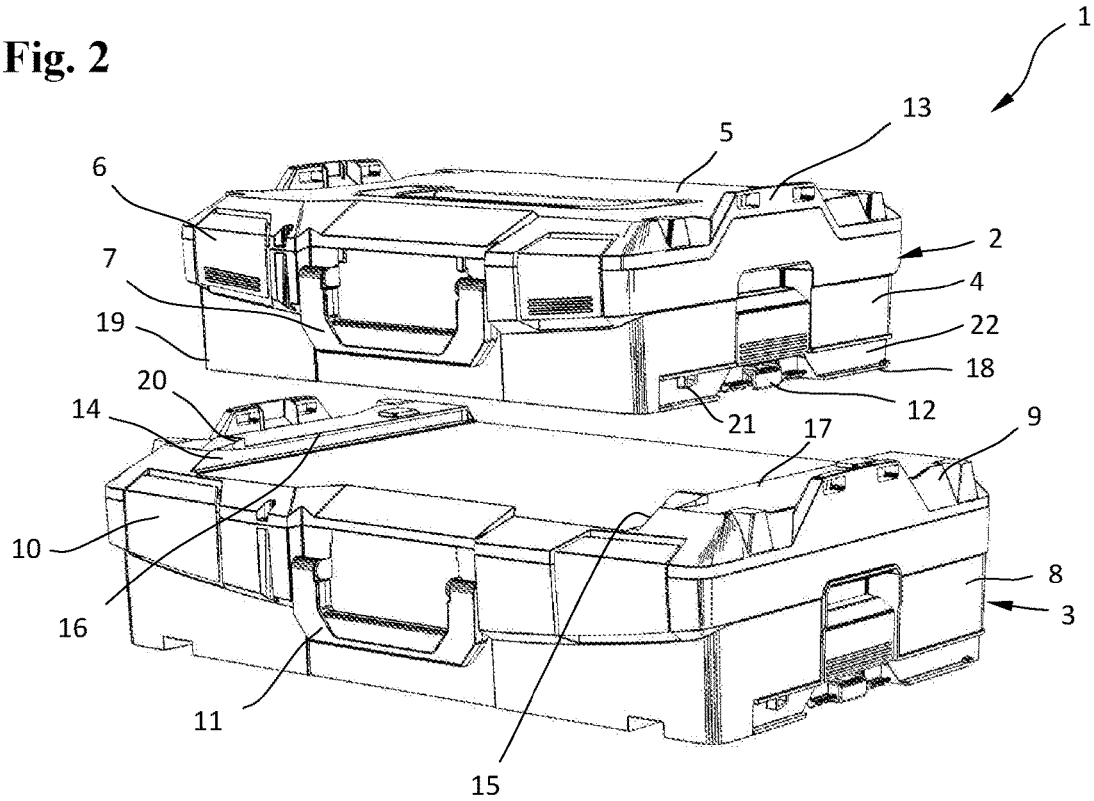
FIG. 2 a perspective view of the transport system of FIG. 1, with a distance between the system container and the additional container.

FIG. 2 shows a perspective view of the transport system 1 of FIG. 1 with two spaced-apart containers 2, 3. As the drawing indicates, the lid part 9 of the lower system container 3 has two spaced-apart parallel guide rails 14, 15 which are designed to form-fittingly receive the upper container 2. The guide rails 14, 15 extend over the entire depth of lid part 9 and are disposed on the lid part 9 at a distance from the opposite side walls, more specifically, from the associated coupling elements formed therein. This ensures that, depending on the requirements, the lower system container 3 can be connected to the slightly smaller upper container 2 by means of the guide rails 14, 15 or, as an alternative, to additional system containers of identical design by means of the coupling elements described with reference to the upper container 2 but identically designed on the lower system container 3.

The guide rails 14, 15 each have a runway 16, 17, which extend horizontally and thus parallel with respect to the upper surface of the lid and which protrude from the guide rails 14, 15 toward each other. In correspondence thereto, the opposite side walls of the bottom part 4 of the upper container 2 each have a running rail 18, 19, which are designed to vertically engage the runways 16, 17 of the guide rails 14, 15 from behind and to hold them.

The containers are 2, 3 are connected in such a way that the running rails 18, 19 on the upper container 2 are inserted into the guide rails 14, 15 so that the running rails 18, 19 engage the runways 16, 17 from below. The running rails 18, 19 are formed by the edges of the bottom plates of the bottom part 4 of the upper container 2, which edges protrude laterally from the opposite side walls of the bottom part 4.

To prevent the upper container 2 from being unintentionally disengaged from the lower system container 3, a locking device is provided for locking the upper container 2 in an inserted locking position relative to the lower system container 3, which locking device comprises a locking lug 20, which is attached to the lid part 9 of the lower system container 3, and a locking stop 21 which is attached to the bottom part 4 of the upper container 2. In the embodiment shown, a locking lug 20 is each disposed on the guide rails 14, 15, and a locking stop 21 is each disposed on the running rails 18, 19 so that the described mirror-image structure of the containers 2, 3 is maintained.

In the illustrative embodiment shown, the guide rails 14, 15 have an open front end and, opposite thereto, a closed rear end so that the upper container 2 can be inserted only from the front. The locking lugs 20 are integrally formed in the runways 16, 17 at the top on the open end of the guide rails 14, 15 and protrude vertically upwardly. Complementary thereto, the locking stops are formed in a lateral recess of the respective side wall of the bottom part 4, which, by way of an example, is illustrated by the locking stop 21 in the lateral recess 22. Like the locking stop 21 in the lateral recess 22, the locking stops protrude vertically downward.

To ensure that the upper container 2 is securely locked into the guide rails 14, 15 of the lower system container 3, the locking stops 21 protrude downwardly just far enough so that the distance between the upper edge of the running rails 18, 19 and the lower edge of the locking stops is greater than the vertical overhang and thus the height of the locking lugs 20. Thus, to disengage the connection, in the inserted position, a front section of the upper system container 2, for example, the carrying handle 7, can be raised and thus tilted about an axis at right angles relative to the pull-out direction so that the locking stops 21 are raised above the locking lugs 20 and moved away from them. In addition, to further facilitate the insertion and locking connection of the upper container 2, the locking lugs 20 and/or the locking stops 21 can be provided with a flattened portion in the push-in direction, which, on contact of the locking lugs 20 and the locking stops 21 during insertion, causes the upper system container 2 to be automatically raised and thus allows the locking stops 21 to override the locking lugs 20 particularly easily during insertion.

As FIG. 2 also indicates, the lower system container 3 does not have a second carrying handle between the guide rails 14, 15, for example, such as is provided on the upper container 2 in the form of the second carrying handle 23. In an alternative embodiment, however, such a second carrying handle can be provided on the lower system container 3 between the guide rails 14, 15 as well.

Figure 3:
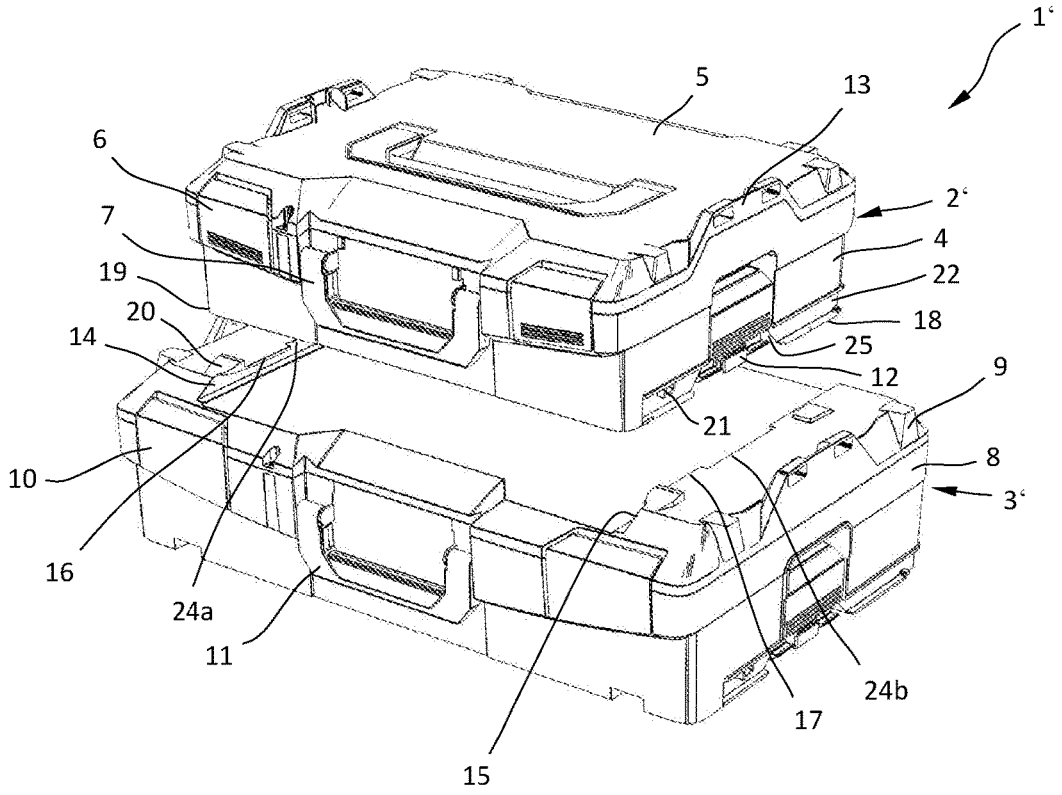
FIG. 3 a perspective view of a second transport system, with two alternative containers or system containers disposed at a distance from each other.

FIG. 3 shows a perspective view of a second transport system 1' with two spaced-apart alternative containers 2', 3'. In contrast to the embodiment described above, the runways 16, 17 of the lower system container 3' each have a recess 24*a*, 24*b*. The other elements are identical to those of the embodiment described above and are designated by the same reference characters.

As in the first embodiment shown in FIGS. 1 and 2, the running rails 18, 19 are each interrupted by a recess in which the coupling device is disposed, as shown by way of example by the recess 25 on the running rail 18 in which the coupling device 12 is disposed.

The upper container 2' can be connected to the lower system container 3' especially quickly in that the running rails 18, 19 of the upper container 2' need not be inserted over the entire length of the runways 16, 17 but only over a shorter portion. Thus, in this embodiment, the rear portions of the running rails 18, 19 can be inserted into the guide rails 14, 15 vertically from above through the recesses 24*a*, 24*b* and can subsequently be pushed up to the stop position in the push-in direction along the guide rails 14, 15. The recesses 24*a*, 24*b* are preferably disposed halfway between the open front end and the closed rear end of the guide rails 14, 15 so that holding power can be transmitted in equal measure via the front and rear portions of the runways 16, 17. To facilitate the assembling procedure, it is provided for the length of the recesses 24*a*, 24*b* in the push-in direction to correspond to at least the extension of the rear portions of the runways 16, 17, which makes vertical insertion possible. However, as an alternative, the length of the recesses 24*a*, 24*b* can be shorter than the extension of the rear portions of the runways 16, 17 so that insertion is possible only by tilting at an angle.

According to an embodiment not included in the drawings, the coupling devices 12 in the inserted locking position can interact with complementary counter elements in the guide rails 14, 15, thus creating an additional or alternative locking device. This locking device can be disengaged in the usual way by compressing the coupling devices 12. By providing appropriate inclined sliding surfaces, the coupling devices 12 can be made to automatically engage in complementary counter elements, for example, latches, when the upper container is being inserted into the rear locking position. As a result, in addition to locking system containers of the same type to each other, the already existing coupling devices 12 can at the same time also be used to detachably secure the containers on the guide rails 14, 15.

In addition, in the embodiments shown, guide rails, similar to the guide rails 14, 15, but spaced at a shorter distance from each other, can also be disposed on the lid part 5 of the upper containers 2, 2' so that an additional smaller system container can also be stacked on and attached to the upper container 2, 2'. Thus, by means of the additional carrying handle 23 of the upper container 2, 2' or the carrying handle of the uppermost container, the transport system as a whole can be readily grasped and transported.

Figure 4:
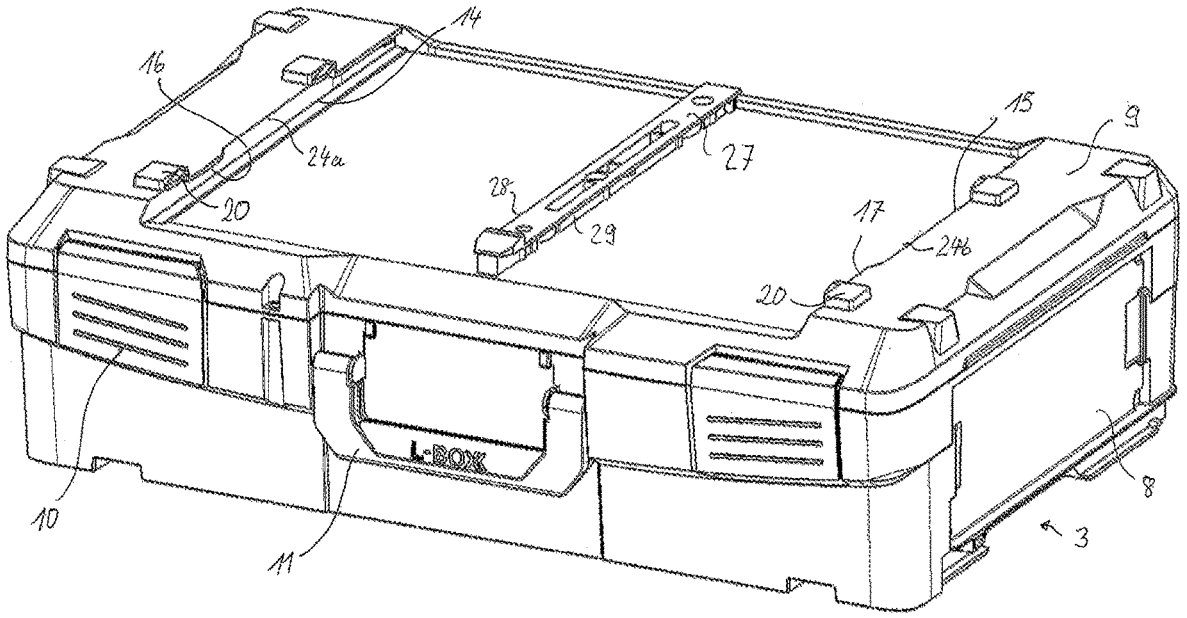
FIG. 4 a perspective view of an alternative embodiment of a system container with an additional runway in the middle.

Another illustrative embodiment of the invention is shown in FIG. 4. In this illustrative embodiment, an additional guide rail 27 is disposed between and parallel to the two guide rails 14 and 15 on the lid part 9 of the lower system container 3, which additional guide rail also has runways 28 and 29 which are disposed opposite to the runways 16 and 17 of the external guide rails 14 and 15. This layout makes it possible to attach a plurality of smaller superjacent containers side-by-side on the lid part 9 of the lower system container 3.

LIST OF REFERENCE CHARACTERS

1, 1' Transport system
2, 2' Upper container
3, 3' Lower system container
4 Bottom part of the upper container
5 Lid part of the upper container
6 Locking tab of the upper container
7 Carrying handle of the upper container
8 Bottom part of the lower system container
9 Lid part of the lower system container
10 Locking tab of the lower system container
11 Carrying handle of the lower system container
12 Coupling device
13 Coupling element

14 First guide rail
15 Second guide rail
16 First runway
17 Second runway
18 First running rail
19 Second running rail
20 Locking lug
21 Locking stop
22 Lateral recess
23 Additional carrying handle of the upper container
24*a*, 24*b* Recess
25 Recess

The invention claimed is:

1. A system of interconnecting stackable containers comprising:

a lower container; and an upper container configured for stacking on the lower container and connecting thereto, wherein the lower container includes:

a bottom part;

a lid part pivotably attached to the bottom part;

two spaced-apart guide rails on an upper surface of the lid part for form-fittingly receiving the upper container, with the guide rails each having a runway, the runways protruding toward each other and configured to be engaged by the upper container; and at least one upwardly protruding locking lug disposed on the lid part and integrally formed in one of the guide rails, the at least one locking lug having a flattened portion in a push-in direction so as to cause the upper container to be automatically raised during insertion, and wherein the upper container includes:

a lid part;

a bottom part having two running rails disposed thereon; and a locking stop formed in a lateral recess of the bottom part.

2. The system of interconnecting stackable containers of claim 1, wherein the guide rails are aligned parallel to each other.

3. The system of interconnecting stackable containers of claim 1, wherein the runways of the guide rails each have at least one recess.

4. The system of interconnecting stackable containers of claim 1, wherein an additional guide rail is disposed on the lid part of the lower container between the two guide rails.

5. The system of interconnecting stackable containers of claim 1, wherein the guide rails are integrally formed in the lid part of the lower container.

6. The system of interconnecting stackable containers of claim 1, wherein the running rails are formed to be complementary to the guide rails.

7. The system of interconnecting stackable containers of claim 1, wherein the running rails are formed by edges of bottom plates of the bottom part of the upper container and wherein the edges protrude laterally from opposite side walls of the bottom part of the upper container.

8. The system of interconnecting stackable containers of claim 1, wherein the running rails each have a recess.

9. The system of interconnecting stackable containers of claim 1, wherein a distance between an upper edge of the running rail and a lower edge of the locking stop of the upper container is greater than a height of the at least one locking lug.

10. A transport system comprising:

at least one system container; and a second container, wherein the at least one system container includes a lid part on which guide rails each having a runway are disposed, which runways are engaged from behind and held by complementary running rails of the second container, the runways protrude toward each other, and at least one upwardly protruding locking lug is disposed on the lid part, is integrally formed in one of the guide rails, and has a flattened portion in a push-in direction so as to cause the second container to be automatically raised during insertion and to guide the second container in a pull-out direction, and wherein the second container includes a locking stop configured for insertion into a rear locking position, and wherein a distance between an upper edge of the running rails of the second container and a lower edge of the locking stop of the second container is greater than a height of the at least one locking lug of the at least one system container.

11. The transport system of claim 10, wherein the locking stop is formed on one of the running rails.

12. The transport system of claim 10, wherein the flattened portion of the at least one locking lug, on contact of the at least one locking lug and the locking stop during insertion, causes the second container to be automatically raised such that the locking stop overrides the at least one locking lug during insertion.

* * * * *